US007510068B2

(12) United States Patent
Rizzoli et al.

(10) Patent No.: US 7,510,068 B2
(45) Date of Patent: Mar. 31, 2009

(54) COMBINATION UNIT FOR THE MANUFACTURE OF TOBACCO PRODUCTS

(75) Inventors: Salvatore Rizzoli, Bologna (IT); Fiorenzo Draghetti, Medicina (IT)

(73) Assignee: G.D. S.p.A., Bologna (IT)

( * ) Notice: Subject to any disclaimer, the term of this patent is extended or adjusted under 35 U.S.C. 154(b) by 279 days.

(21) Appl. No.: 11/046,830

(22) Filed: Feb. 1, 2005

(65) Prior Publication Data

US 2005/0166932 A1 Aug. 4, 2005

(30) Foreign Application Priority Data

Feb. 3, 2004 (IT) ..... BO2004A0046

(51) Int. Cl.
*B65G 17/46* (2006.01)

(52) U.S. Cl. ..... 198/471.1; 198/432; 131/282

(58) Field of Classification Search ..... 198/432, 198/450, 469.1, 470.1, 471.1, 478.1, 598, 198/596; 131/282, 283; 83/152, 153
See application file for complete search history.

(56) References Cited

U.S. PATENT DOCUMENTS

| | | | | |
|---|---|---|---|---|
| 3,039,606 A | | 6/1962 | Dearsley | |
| 4,390,779 A | | 6/1983 | Heikel | |
| 4,645,063 A | * | 2/1987 | Seragnoli | 198/471.1 |
| 5,255,777 A | * | 10/1993 | Pawelko | 198/471.1 |
| 5,327,803 A | * | 7/1994 | deMey, III | 198/471.1 |
| 6,105,750 A | * | 8/2000 | Belvederi | 198/432 |
| 7,070,039 B2 | * | 7/2006 | Dombek | 198/432 |
| 7,131,524 B2 | * | 11/2006 | Wohltmann | 198/471.1 |
| 7,165,668 B2 | * | 1/2007 | Dombek | 198/471.1 |

FOREIGN PATENT DOCUMENTS

| | | |
|---|---|---|
| EP | 0641524 | 3/1995 |
| FR | 2037659 | 12/1970 |
| GB | 994813 | 6/1965 |
| GB | 1062028 | 3/1967 |

* cited by examiner

*Primary Examiner*—James R Bidwell
(74) *Attorney, Agent, or Firm*—Timothy J. Klima

(57) ABSTRACT

Filter cigarettes are turned out by a combination unit composed of a cigarette maker coinciding with a substantially horizontal first leg, also a filter tip attachment machine coinciding with a second leg, of which the downstream machine is equipped with an infeed roller turning on a horizontal axis lying transverse to the second leg. The first and second legs extend parallel one with another and are linked by a transfer unit rotatable about an essentially vertical center axis and incorporating a plurality of holders, each designed to take up two cigarette sticks from an outfeed end of the upstream machine and direct them through a semi-circular path to an infeed end of the downstream machine.

17 Claims, 4 Drawing Sheets

COMBINATION UNIT FOR THE MANUFACTURE OF TOBACCO PRODUCTS

BACKGROUND OF THE INVENTION

The present invention relates to a combination unit for making tobacco products.

Such combinations are composed of a first machine and a second machine linked one to the other by a transfer unit.

The first and the second machine could consist respectively in a filter maker and a user machine, or alternatively, a cigarette maker capable of forming a single tobacco rod or multiple tobacco rods (two or three), and a filter tip attachment machine, which will combine to make up a cigarette manufacturing line.

Reference is made in the present specification to this second type of combination, albeit implying no limitation.

A typical filter cigarette manufacturing line includes a cigarette maker defining a substantially horizontal first leg, installed in series with at least one filter tip attachment machine comprising a plurality of rollers ordered in such a way as to establish a second leg substantially transverse to the first leg.

The two machines are linked by a transfer unit such as will pick up cigarettes at the outfeed of the first leg and place them in aspirating grooves on the surface of revolution presented by an infeed roller at the start of the second leg.

Manufacturing lines of this type are affected by the drawbacks of being bulky, and of having to rely on transfer units generally unable to handle the high operating speeds of modern cigarette making and filter tip attachment machines, inasmuch as the cigarettes are subjected to notable stresses during the passage from the first to the second machine.

The object of the present invention is to provide a combination unit of compact dimensions, embodied in such a way that the stresses on the cigarettes during their transfer from the first machine to the second will be significantly reduced.

SUMMARY OF THE INVENTION

The stated object is realized according to the invention in a combination unit for manufacturing tobacco products typically of elongated cylindrical appearance, comprising a substantially horizontal first leg identifiable with a first machine, and a second leg identifiable with a second machine, including at least one infeed roller rotatable about an axis extending horizontally and transverse to the second leg.

The first leg and second leg of the combination unit disclosed are arranged substantially parallel one with another and interconnected by a transfer unit rotatable about a substantially vertical axis and comprising a plurality of holder elements such as will carry at least one relative tobacco product from an outfeed end of the first machine along a given transfer path to an infeed end of the second machine.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
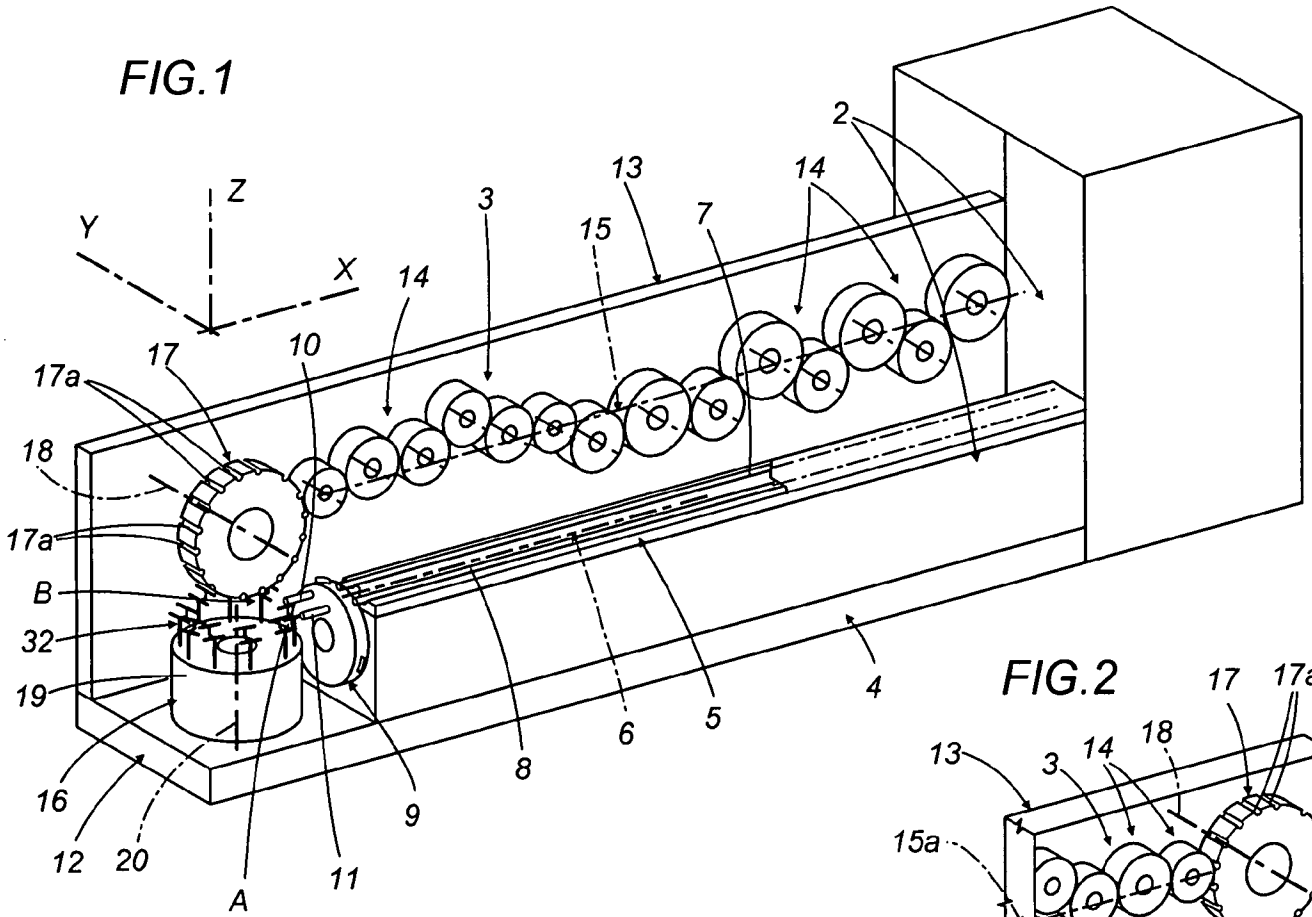
FIG. 1 illustrates a first embodiment of the combination unit according to the invention, viewed schematically and in perspective with certain parts omitted for clarity.

Referring to FIG. 1 of the drawings, 1 denotes a combination unit, in its entirety, incorporating machines for the manufacture of tobacco products typified by an elongated cylindrical appearance, in particular filter cigarettes.

The unit 1 includes a first machine consisting in a cigarette maker 2 equipped with two tobacco rod processing lines as disclosed in U.S. Pat. Ser. No. 4,418,705, to which reference may be made for a fuller description, and a second machine consisting in a filter tip attachment machine 3.

The cigarette maker 2 comprises a bed 4 carrying an outfeed beam 5 that coincides in practice with a substantially horizontal leg 6 of the unit 1, along which two continuous cigarette rods 7 and 8 are caused to advance axially at substantially constant and identical rates of feed toward a rotary cutter head 9 of conventional type. The rods 7 and 8 are divided up by the cutter into respective sticks 10 and 11 each measuring twice the length of a single cigarette.

Figure 2:
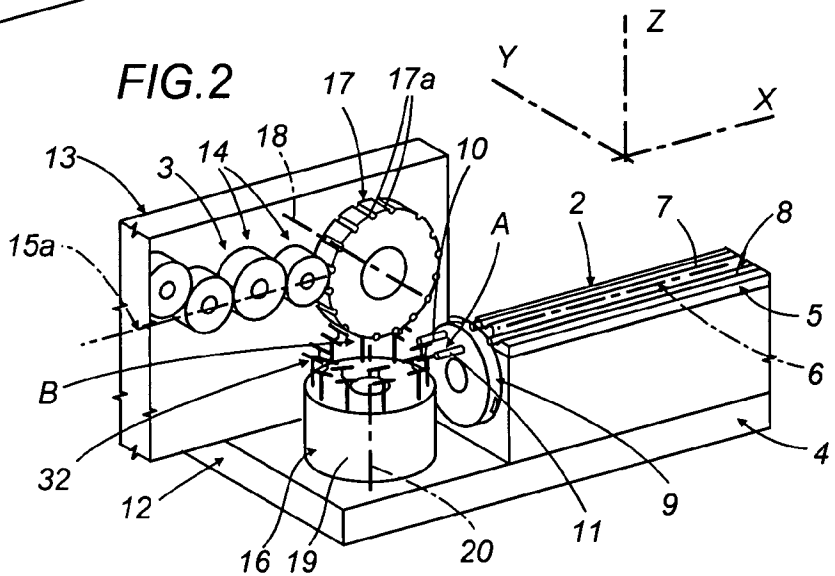
FIG. 2 illustrates a second embodiment of the combination unit according to the invention, viewed schematically and in perspective with certain parts omitted for clarity.
Figure 3:
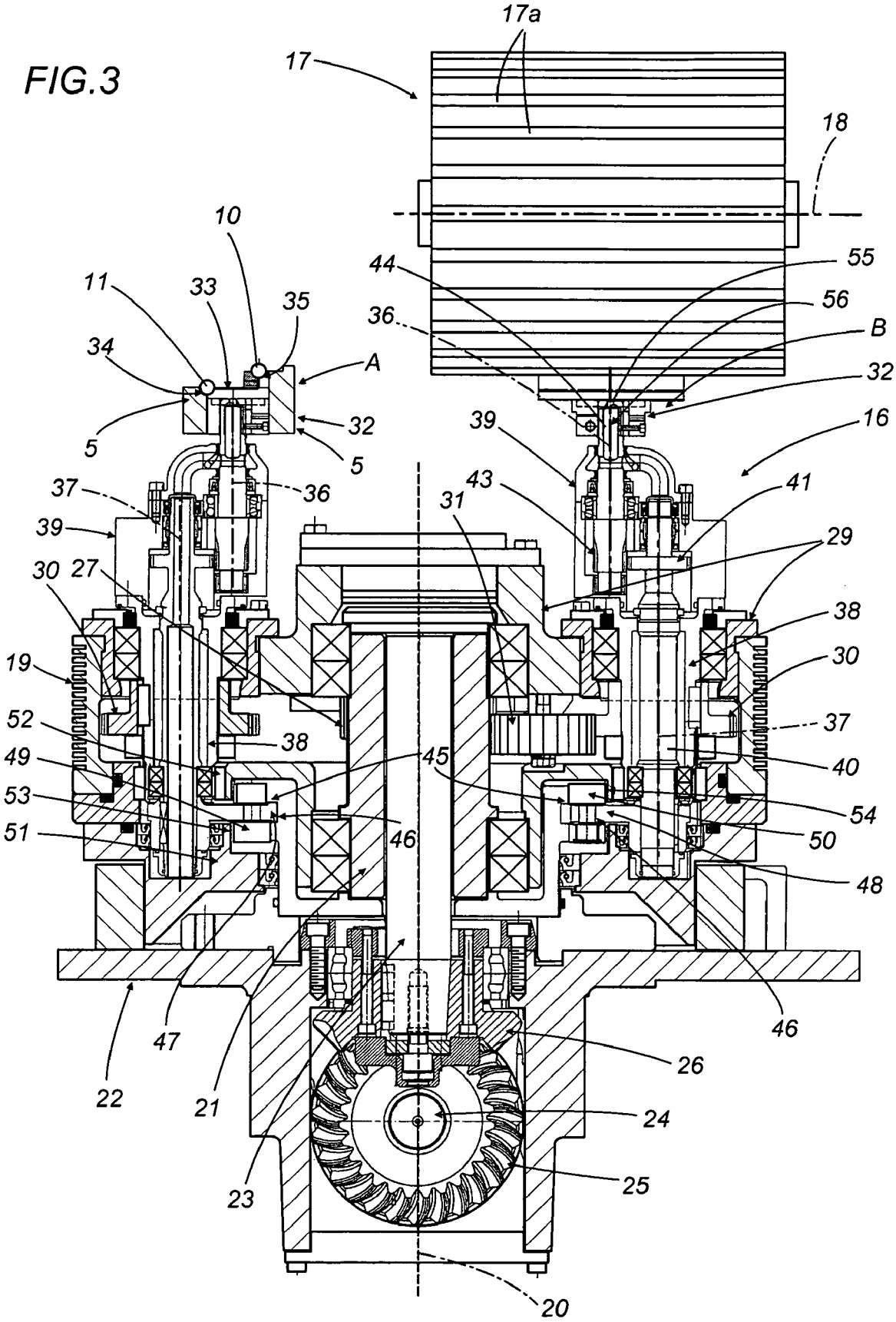
FIG. 3 shows a detail of FIGS. 1 and 2, viewed schematically in elevation and in section.

As discernible from FIGS. 1, 2 and 3, the two rods 7 and 8 are made to advance at two different heights, at least along the final part of the beam, and more exactly, the rod 7 on the inboard side of the beam is elevated relative to the other rod 8.

The filter tip attachment machine 3 comprises a bed 12 surmounted by a vertical bulkhead 13 that extends parallel to the outfeed beam 5 and to the rear of the selfsame beam, as viewed in FIG. 1. The vertical bulkhead 13 carries a plurality of rollers denoted 14 in their entirety, mounted with axes disposed transversely to the bulkhead 13 and coinciding with a leg 15 of the unit 1 that extends in a direction substantially parallel to that of the leg 6 first mentioned.

16 denotes a transfer unit interconnecting the cigarette maker 2 and the filter tip attachment machine 3, of which the function is to direct the sticks 10 and 11 singly and in succession from the outfeed end of the one leg 6, identifiable also as a take-up station denoted A, to an infeed end of the other leg 15, identifiable also as a release station denoted B and coinciding with an infeed roller 17 of which the axis is denoted 18. The periphery of the roller 17 in question presents a plurality of aspirating grooves 17*a*, familiar in embodiment, each able to accommodate a respective cigarette stick 10 or 11.

As illustrated in FIGS. 1 and 3, the transfer unit 16 comprises a cylindrical body 19 of which the axis 20 is vertically disposed. More exactly, it will be seen that the two legs 6 and 15 extend along a direction parallel to the "X" axis of a set of Cartesian coordinates (indicated in FIG. 1), whilst the axis 18 of the infeed roller 17 and the axis 20 of the cylindrical body 19 of the transfer unit 16 extend in directions parallel respectively to the "Y" axis and to the "Z" axis.

Figure 4:
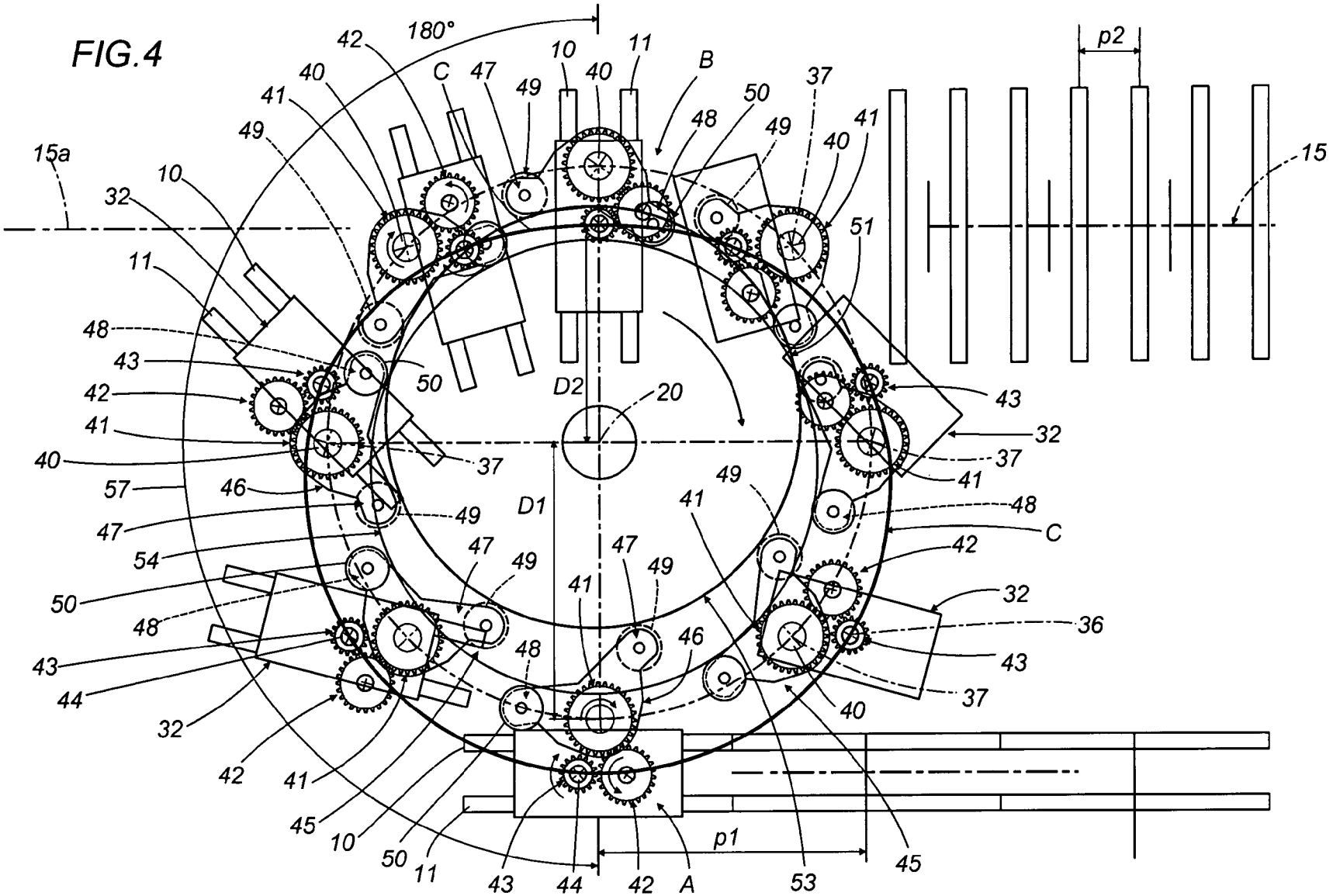
FIG. 4 is a schematic plan view of the detail in FIG. 3, shown with certain parts omitted.
Figure 5:
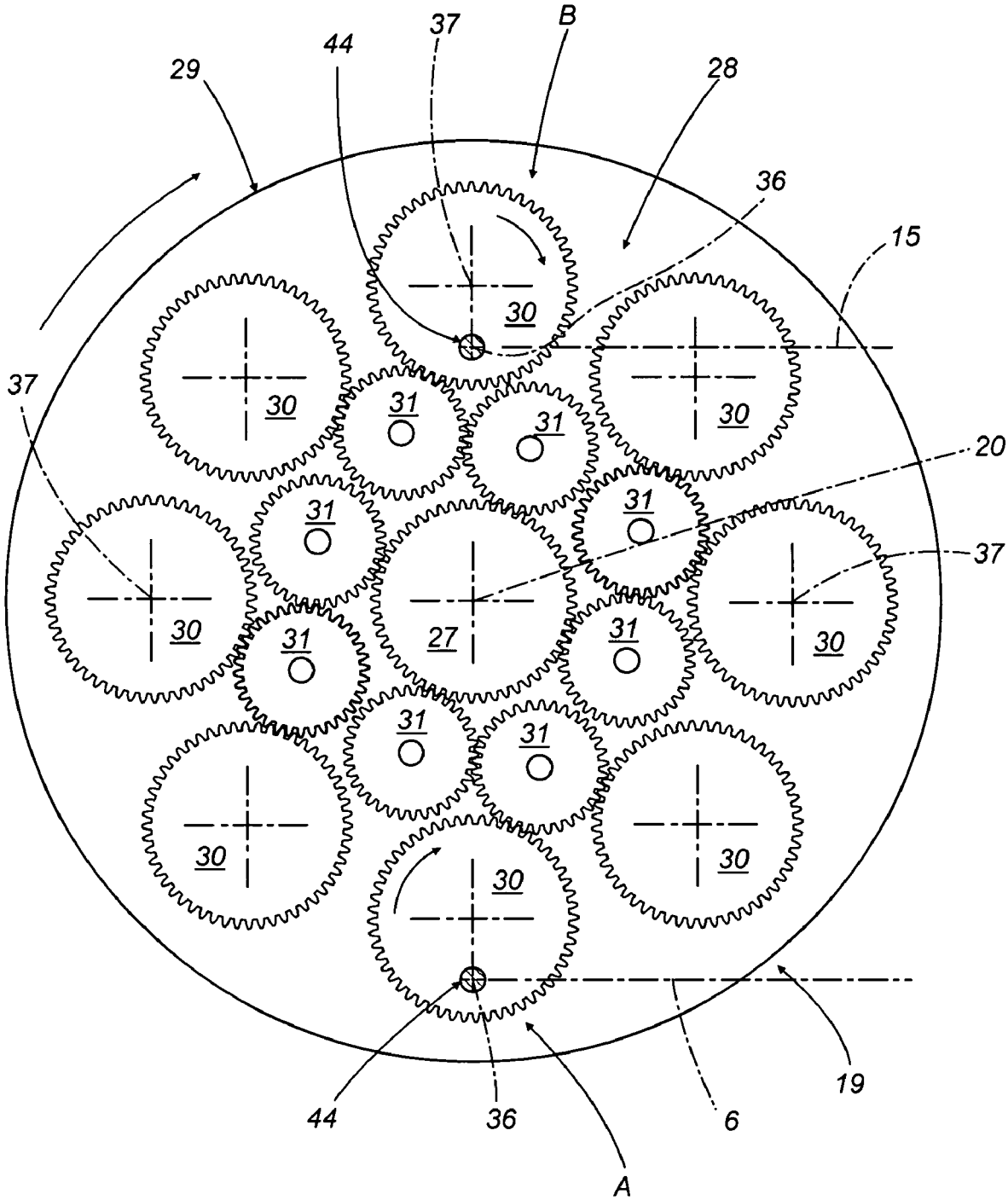
FIG. 5 is a schematic plan view showing a train of gears utilized in the detail of FIG. 3.

In particular, and as illustrated in FIGS. 3, 4 and 5, the transfer unit 16 incorporates a fixed vertical sleeve 21 centered on the axis 20 of the cylindrical body 19, anchored at the bottom end to a mounting denoted 22 and accommodating a coaxially aligned shaft 23.

This same vertical shaft 23 is power driven from the bottom end by a further shaft 24, disposed at right angles, to which it is coupled by way of a bevel gear pair 25-26.

Keyed onto the top end of the sleeve 21 is the fixed sun gear 27 of an epicyclic train, denoted 28 in its entirety (FIG. 5), which also includes a planet carrier 29 concentric with the sun gear 27, and a plurality of planet gears 30 mounted freely to the planet carrier 29 and coupled to the sun gear 27 by way of intermediate idle gears 31.

It will be seen in FIG. 5 that the transmission ratio between the sun gear 27 and the single planet gears 30 is 1:1.

The transfer unit 1 comprises a plurality of holder elements 32 each associated with a relative planet gear 30 and including a plate 33 of which the upwardly directed surface presents two parallel grooves 34 and 35 set at different heights, for reasons that will become apparent. The plate 33 is centered on a vertical axis 36 offset from the axis of rotation 37 of the planet gear 30.

More exactly, referring to FIGS. 3 and 4, the planet gear 30 is keyed to a tubular portion 38 extending downward from a hollow block 39 that carries the holder element 32.

The tubular portion 38 houses a first shaft 40 centered on and rotatable about the planet axis 37, of which a first top end carries a first gear 41 meshing by way of an idle gear 42 (see FIG. 4) with a further gear 43 carried by the bottom end of a second shaft 44 coaxial with the axis 36 of the plate 33 and connected to the holder element 32 at its top end.

The first shaft 40 is connected at the bottom end to a cam and rocker mechanism, denoted 45 in its entirety, comprising an element 46 with two arms 47 and 48 which occupy a common plane and are arranged substantially in a Vee formation with the vertex of the Vee keyed to the shaft 40.

The cam and rocker mechanism 45 further comprises respective following rollers denoted 49 and 50, the one mounted underslung to the arm denoted 47, the other mounted overslung to the arm denoted 48.

Finally, the mechanism 45 comprises cam means 51 that consist in a cylindrical body 52 associated rigidly with the sleeve 21, presenting a lower first profile 53 positioned to interact with one following roller 49, and an upper second profile 54 positioned to interact with the other following roller 50.

The two cam profiles 53 and 54 are offset one from another and from the axis 20 of the sun gear, their geometry and placement being such that the single holder elements 32 will be caused to pivot on the relative axes 36 as the planet carrier 29 rotates about the sun gear.

Operationally, the cam and rocker mechanism 45 combines with the first and second shafts 40 and 44, with the first gear 41, and with the gears denoted 42 and 43, establishing means by which to control the axial orientation of the cigarette sticks 10 and 11.

Referring finally to FIG. 3, the two grooves 34 and 35 presented by the plate 33 of the holder element 32 are embodied in conventional manner with suction holes arranged along the bottom surface and connected to a source of negative pressure likewise conventional in embodiment (not illustrated) by way of ducts 56 passing through portions of the second shaft 44 and of the hollow block 39.

In practical application, the transfer unit 16 will be positioned below the outfeed beam 5 of the cigarette maker 2 and the infeed roller 17 of the filter tip attachment machine 3, with the infeed roller 17 rotating tangentially at its lowest point to the horizontal plane occupied by the beam 5.

The transfer unit 16 operates in such a manner as to direct the single holder elements 32 through a trajectory extending from a position at the take-up station A, below the outfeed beam 5, to a position at the release station B beneath the roller 17.

To reiterate, the grooves 34 and 35 of the single holder elements 32 are set at different heights so that the two sticks 10 and 11 can be taken up at the two dissimilar elevations aforementioned, and transferred to two contiguous grooves 17*a* of the infeed roller 17 at different heights, coinciding with those of the grooves 34 and 35 presented by the plate 33.

As discernible from FIG. 4, and in accordance with standard practice, the cut cigarette sticks 10 and 11 are taken up from the beam 5 at the one station A advancing at a given pitch denoted p1, and released to the other station B spaced apart at a reduced pitch p2; pitch p1 might be 128 mm, for example, and pitch p2 could be 38 mm, equivalent to the distance separating the two cigarette rods 7 and 8.

The transfer unit 16 is designed to bring about a corresponding reduction in speed of the sticks 10 and 11, which are taken up from the first station A at a higher tangential velocity substantially equal to the linear velocity of the rods 7 and 8, and then released to the second station B at a lower tangential velocity equal to the angular velocity at the periphery of the infeed roller 17 serving the filter tip attachment machine 3. In effect, it will be seen from FIG. 4 that the second shaft 44 supporting the holder element 32 is at a maximum distance D1 from the axis 20 of the cylindrical body 19 when passing through the take-up station 4, and at a minimum distance D2 from this same axis 20 when passing through the release station B. It will be seen also from the schematic representation of FIG. 5 that the positions of maximum and minimum distance, diametrically opposed on either side of the sun gear 27, are assumed by the shaft 44 as a result of the relative planet gear 30 rotating 180° about its axis 37 when the planet carrier 29 is set in motion around the sun axis 20.

Observing FIG. 4, it will be seen that the trajectory followed by each of the second shafts 44 carrying a respective holder element 32 appears as a circumference denoted C, flattened slightly in the neighborhood of the release station B.

Referring to the foregoing description of the embodiment illustrated in FIG. 1, where the two legs 6 and 15 are disposed substantially parallel with one another and in the same plane, the single holder elements 32 describe an arc 57 of 180° in passing from the take-up station A to the release station B.

In the course of this same rotation, the means controlling the axial orientation of the sticks 10 and 11 will cause each pair of sticks to pass from a position at the take-up station A in which the two axes are parallel with the first leg 6, to a position at the release station B in which the same two axes are rotated through 90° and parallel with the axis 18 of the infeed roller 17 of the filter tip attachment machine 3, hence transverse to the second leg 15.

More exactly, as the planet carrier rotates about the sun axis 20, the interaction of the following rollers 49 and 50 with the two cam profiles 53 and 54 will cause the element 46 with the two arms to rotate clockwise, as viewed in FIG. 4.

This same angular movement is accompanied by a rotation of the first shaft 40 about the relative axis 37, also of the first gear 41 and, by way of the corresponding idle gear 42 and intermediate gear 43, of the second shaft 44 carrying the holder element 32, likewise about the relative axis 36.

One of the advantages of the transfer unit 16 disclosed is that the reduction in pitch from p1 to p2 can be brought about along an arc of 180°, and therefore in a time substantially twice as long as the time taken by right angle units typical of the prior art.

Accordingly, the deceleration of the advancing sticks 10 and 11 is brought about more gradually, and the stresses acting on the selfsame sticks are thus significantly reduced.

Finally, it will be seen that the element 46 with two arms could be replaced by an element with just one arm and a relative following roller positioned to engage a relative single cam profile, albeit the solution shown in FIG. 4 offers the advantage of greater precision in that it is a positive acting mechanism able to eliminate backlash.

As illustrated in FIG. 2, moreover, the filter tip attachment machine 3 might present a second leg, in this instance denoted 15*a*, extending in a direction opposite to that illustrated in FIG. 1.

What is claimed is:

1. A combination unit for the manufacture of tobacco products having an elongated cylindrical appearance, comprising:

a substantially horizontal first leg associated with a first machine;

a second leg, extending substantially parallel to the first leg and associated with a second machine, including at least one infeed roller rotatable about an axis extending horizontally and transverse to the second leg;

a transfer unit interconnecting the first leg and the second leg, rotatable about a substantially vertical axis and comprising a plurality of holder elements such as will carry at least one tobacco product each from an outfeed end of the first machine along a predetermined transfer path to an infeed end of the second machine, wherein the transfer unit includes an epicyclic train having a fixed sun gear, a power driven planet carrier rotatable about the vertical axis and centered on the sun gear, a plurality of planet gears numbering one to each holder element and, associated with each holder element, means by which to control an axial orientation of the tobacco product between directional positions respectively parallel to the first leg and transverse to the second leg.

2. A unit as in claim 1, wherein the first path and the second path are arranged in line with one another.

3. A unit as in claim 1, wherein the first path and the second path are arranged substantially alongside one another.

4. A unit as in claim 1, wherein the means by which to control the axial orientation of the tobacco product comprise a cam and rocker mechanism.

5. A unit as in claim 4, wherein the cam and rocker mechanism is a positive acting mechanism.

6. A unit as in claim 5, wherein the means by which to control the axial orientation of the tobacco product comprise, for each holder element, a first shaft coaxial with the relative planet gear, and a gear associated with a first end of the shaft, from which motion is transmitted by way of an idle gear to a gear associated rigidly and coaxial with a second shaft carrying the holder element.

7. A unit as in claim 6, wherein a second end of the first shaft is connected to the cain and rocker mechanism.

8. A unit as in claim 1, comprising a plurality of idle gears interposed between the sun gear and the planet gears of the epicyclic train, wherein the transmission ratio between the sun gear and the planet gears is 1:1.

9. A unit as in claim 5, wherein the cain and rocker mechanism comprises an element having two arms pivotable about an axis coinciding with the axis of the first shaft and, carried by the ends of the two arms, two respective cam-following rollers interacting with respective cam profiles constituting the cam means and embodied in such a way as will cause the first shaft to pivot about the respective axis during the rotation of the power driven planet carrier.

10. A unit as in claim 1, wherein the single holder elements are made to follow a predetermined transfer path extending through an arc of 180°.

11. A unit as in claim 1, wherein the first machine is a one-track single rod or a twin-track dual rod cigarette maker, and the second machine is a filter tip attachment machine.

12. A unit as in claim 1, wherein the first machine is a filter maker.

13. A unit as in claim 1, wherein directions of alignment of the first leg, the axis of the infeed roller of the second leg and the axis of the transfer unit extend parallel respectively with the axes X, Y and Z of a set of Cartesian coordinates.

14. A unit as in claim 1, wherein an elevation of at least a final portion of the first leg coincides substantially with an elevation of a bottom portion of the intend roller.

15. A unit as in claim 6, wherein the cam and rocker mechanism comprises an element having two arms pivotable about an axis coinciding with the axis of the first shaft and, carried by the ends of the two arms, two respective cam-following rollers interacting with respective cam profiles constituting the cam means and embodied in such a way as will cause the first shaft to pivot about the respective axis during the rotation of the power driven planet carrier.

16. A unit as in claim 7, wherein the cam and rocker mechanism comprises an element having two arms pivotable about an axis coinciding with the axis of the first shaft and, carried by the ends of the two arms, two respective cam-following rollers interacting with respective cam profiles constituting the cam means and embodied in such a way as will cause the first shaft to pivot about the respective axis during the rotation of the power driven planet carrier.

17. A unit as in claim 1, wherein each of the holder elements rotates between the first leg and the second leg to alter an axial orientation of the tobacco product carried thereon from a direction parallel to the first leg to a direction transverse to the first leg.

* * * * *